US011274494B2

(12) United States Patent
Leng

(10) Patent No.: US 11,274,494 B2
(45) Date of Patent: Mar. 15, 2022

(54) TELESCOPING LADDER

(71) Applicant: NEW-TEC INTEGRATION (XIAMEN) CO., LTD., Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 15/458,518

(22) Filed: Mar. 14, 2017

(65) Prior Publication Data

US 2017/0260809 A1 Sep. 14, 2017

(30) Foreign Application Priority Data

Mar. 14, 2016 (CN) ..... 201620193825.4

(51) Int. Cl.

| | |
|---|---|
| ***E06C 1/18*** | (2006.01) |
| ***E06C 1/22*** | (2006.01) |
| ***E06C 1/32*** | (2006.01) |
| ***E06C 1/38*** | (2006.01) |
| ***E06C 7/08*** | (2006.01) |
| ***E06C 7/42*** | (2006.01) |

(52) U.S. Cl.

CPC ..... *E06C 1/18* (2013.01); *E06C 1/22* (2013.01); *E06C 1/32* (2013.01); *E06C 1/38* (2013.01); *E06C 7/08* (2013.01); *E06C 7/423* (2013.01)

(58) Field of Classification Search

CPC ..... E06C 1/18; E06C 1/38; E06C 7/08; E06C 7/423

See application file for complete search history.

(56) References Cited

U.S. PATENT DOCUMENTS

| | | | | | |
|---|---|---|---|---|---|
| 2,037,860 | A * | 4/1936 | Wilheim | E06C 7/08 | 182/207 |
| 2,605,950 | A * | 8/1952 | Colvin | E06C 7/48 | 182/214 |
| 3,291,258 | A * | 12/1966 | Ruth | E06C 1/12 | 182/211 |
| 4,207,886 | A * | 6/1980 | Sorenson | E06C 7/42 | 182/172 |

(Continued)

FOREIGN PATENT DOCUMENTS

| | | | | |
|---|---|---|---|---|
| CA | 2932305 A1 * | 5/2017 | ..... | E06C 7/50 |
| CA | 2932305 A1 * | 5/2017 | ..... | E06C 1/12 |

*Primary Examiner* — Colleen M Chavchavadze
*Assistant Examiner* — Candace L Bradford
(74) *Attorney, Agent, or Firm* — Cooper Legal Group, LLC

(57) ABSTRACT

A telescoping ladder includes first and second telescoping ladder racks each having a top portion and including an outer ladder rack having first and second outer legs having interior surfaces that are sliding surfaces; and an inner ladder rack having a first and second inner legs having a sliding surface that slidably engages the sliding surface of the first outer leg along the length thereof, and the second inner leg having a sliding surface that slidably engages the sliding surface of the second outer leg along the length thereof. The top portions are pivotally connected to form a structure that articulates to open and close the ladder. The outer and inner ladder racks are configured as elongated hollow tubes that have a cross section of a closed tube having a protuberance extending therefrom. The outer legs have lateral support legs having protruding ribs to form a stabilizing support structure.

16 Claims, 8 Drawing Sheets

(56) References Cited

U.S. PATENT DOCUMENTS 4,376,470 A * 3/1983 Ashton ..... E06C 1/22 182/207
4,632,220 A * 12/1986 Murrell ..... E06C 7/44 182/111
4,750,587 A * 6/1988 McAllister ..... E06C 7/08 182/161
4,796,727 A * 1/1989 Eaton ..... E06C 1/22 182/168
4,802,643 A * 2/1989 Uys ..... H02G 3/0456 182/228.6
4,951,780 A * 8/1990 Kim ..... E04G 1/30 182/119
4,997,061 A * 3/1991 Aymes ..... E04H 4/144 182/106
5,590,739 A * 1/1997 High ..... E06C 1/12 182/169
5,918,699 A * 7/1999 Summers ..... E06C 7/46 182/107
6,105,722 A * 8/2000 Taylor ..... E06C 7/42 182/107
6,269,909 B1 * 8/2001 Grimes ..... E06C 1/12 182/129
6,702,066 B1 * 3/2004 Eaton ..... E06C 7/44 182/201
6,866,117 B2 * 3/2005 Moss ..... E06C 1/32 182/167
7,293,630 B1 * 11/2007 Trebec ..... E06C 7/423 182/172
7,743,886 B2 * 6/2010 Feemster, Jr. ..... E06C 7/46 182/107
2003/0223112 A1 * 12/2003 Weissenbacher ..... G02B 23/16 359/399
2004/0200669 A1 * 10/2004 Saccente ..... E06C 1/18 182/204
2005/0269159 A1 * 12/2005 Lin ..... E06C 1/18 182/209
2010/0038172 A1 * 2/2010 Ralston ..... E06C 7/46 182/107
2017/0211283 A1 * 7/2017 Sommer ..... E04G 5/14
2017/0234059 A1 * 8/2017 Chancerel ..... E06B 5/025 49/466

* cited by examiner

TELESCOPING LADDER

BACKGROUND OF THE INVENTION

1. Field of the Invention

The present invention relates to a ladder, particularly to a telescoping ladder.

2. Background of the Related Art

Ladders are a tool frequently used for climbing operations in our life, such as the replacement of light bulbs, roof maintenance, interior decoration and so on. According to the function, ladd1ers can be divided into telescoping ladders and non-telescoping ladders. The telescoping ladder has adjustable height making it very convenient to use, and it is now the first choice for consumers. The existing telescoping ladder comprises inner legs and outer legs as two parts; the outer leg has a non-closed groove structure and half wraps the inner leg to achieve the ladder telescoping. In actual use, when the ladder telescopes, the inner legs and the outer legs separate apart so the strength of the outer leg is very weak. What is more, the bottom of the ladder is not strong enough and that is a big security risk when used.

SUMMARY OF THE INVENTION

The present invention provides a telescoping ladder with improved strength, which overcomes the disadvantages of the existing known technology. The technical proposal of the present invention is as follows.

A telescoping ladder, comprises two telescoping ladder racks, the top of the two telescoping ladder racks are pivoted together in a scissor structure that can be opened and closed. The telescoping ladder rack comprises an inner ladder rack and an outer ladder rack connected together in stretching way. The inner ladder rack comprises two inner legs and an inner cross beam connecting the two inner legs. The outer ladder rack comprises two outer legs and an outer cross beam connecting the two outer legs. The inner leg is slidably connected to the outer leg, wherein the cross section of the inner leg and the outer leg has a closed hollow tube shape. Two outer legs are respectively disposed at the outer side of the two inner legs and the inner cross beam of the inner ladder rack is disposed between the two outer legs of the outer ladder rack.

In another preferred embodiment, the inner cross beam is connected to the inner side surface of the inner leg and the outer cross beam is connected to a front end face of the outer leg faced to the user. The inner ladder rack is embedded within the outer ladder rack. The inner leg is a straight long tube and the outer leg is a straight long tube.

In another preferred embodiment, the outer side surface of the inner leg and the inner side surface of the outer leg form sliding surfaces faced to each other. The sliding surface of the inner leg is disposed with a hook lug and the sliding surface of the outer leg is disposed with a hook lug. The hook lug of the sliding surface of the inner leg is locked to the hook lug of the sliding surface of the outer leg.

In another preferred embodiment, the outer side surface of the inner leg and the inner side surface of the outer leg form sliding surfaces faced to each other. The sliding surface of the inner leg is disposed with a sliding groove and the sliding surface of the outer leg is disposed with a sliding rail. The sliding rail is slidably inserted within the sliding groove.

In another preferred embodiment, the outer side surface of the inner leg and the inner side surface of the outer leg form sliding surfaces faced to each other. The sliding surface of the outer leg is disposed with a sliding groove and the sliding surface of the inner leg is disposed with a sliding rail. The sliding rail is slidably inserted to the sliding groove.

In another preferred embodiment, the sliding groove is a dovetail groove.

In another preferred embodiment, the front end face of the inner leg is aligned with the front end face of the outer leg and the rear end face of the inner leg is aligned with the rear end face of the outer leg.

In another preferred embodiment, the outer side surface of the outer leg is curved and protrudes outwardly.

In another preferred embodiment, the cross section of the inner leg is a right trapezoid or square and the cross section of the outer leg is a right trapezoid or square.

In another preferred embodiment, the outer ladder rack further comprises two support elements respectively connected to the bottom portion of the two outer legs and forming a support structure.

Compared to the existing known technology, the technical solution of the present invention has the following advantages:

1. The cross sections of both the inner leg and the outer leg are a closed hollow tube structures so the strength of the legs is good. They are not easily deformed so they can bear more. Based on the strength requirement, the ladder can use less material. The outer legs are disposed at the outer side of the inner legs, the inner cross beam of the inner ladder rack is disposed between the two outer legs of the outer ladder rack, the inner cross beam is aligned with the outer leg, the inner ladder rack is embedded within the outer ladder rack, the telescoping ladder rack is thin, the ladder has a thin profile when it is folded.

2. The inner legs and the outer legs are straight long tubes achieving a long and stable structure.

3. Two support elements are respectively connected to the bottom portion of the two outer legs and form a support structure. They have a large span and stand stably on the ground so that the stability of the ladder is improved.

BRIEF DESCRIPTION OF THE DRAWING

The present invention will be further described with the drawings and embodiments.

DETAILED DESCRIPTION OF THE EMBODIMENTS

Figure 1:
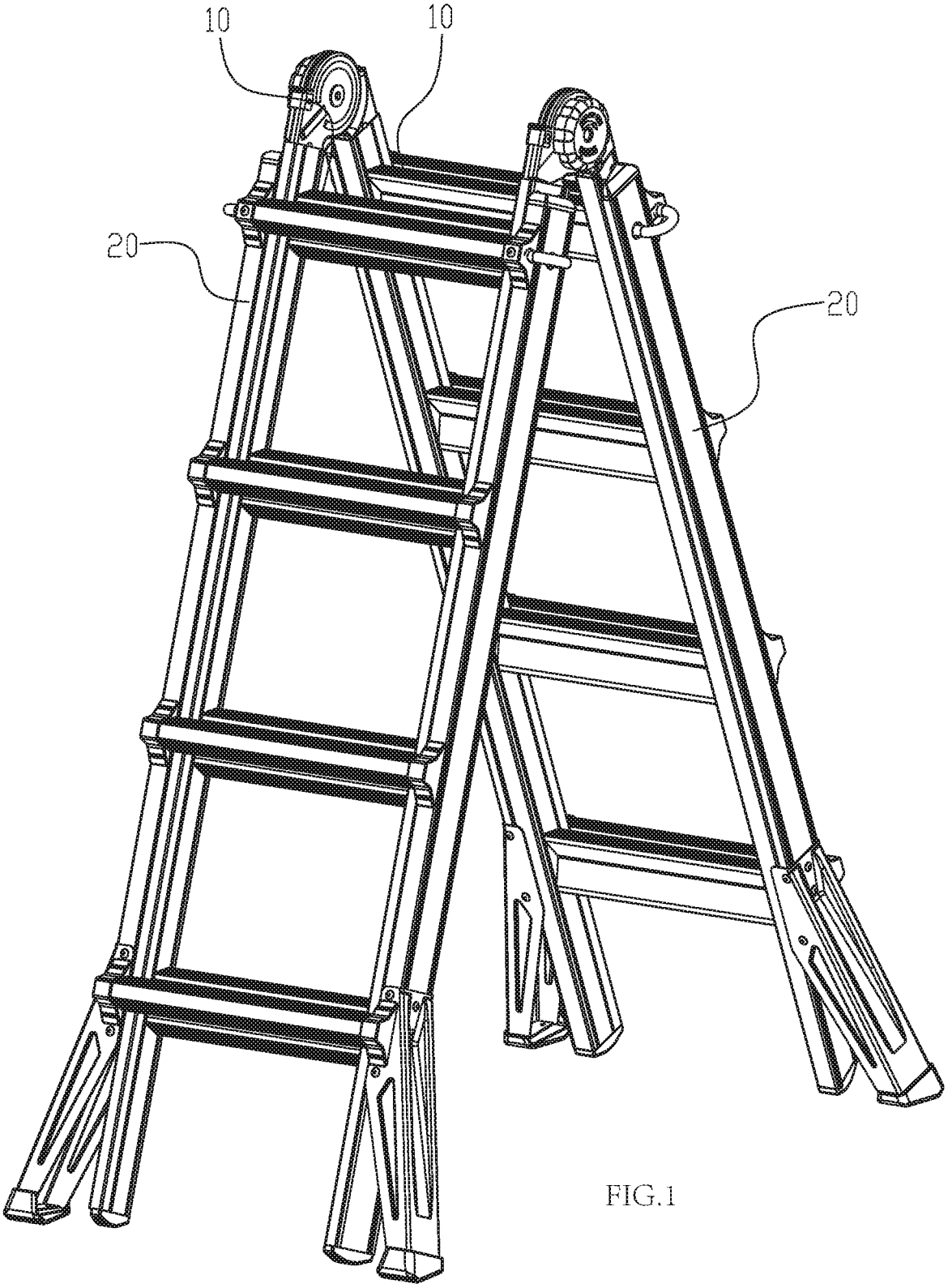
FIG. 1 illustrates a schematic diagram of a telescoping ladder of the present invention.

Referring to FIGS. 1-3*b*, the telescoping ladder comprises two telescoping ladder racks, the top of the two telescoping ladder racks are pivoted together in a scissor structure that can be opened and closed. The telescoping ladder rack comprises an inner ladder rack 10 and an outer ladder rack 20 connected together in a telescoping way. The inner ladder rack 10 comprises two inner legs 12 and a plurality of inner cross beams 14 connecting the two inner legs 12. The outer ladder rack 20 comprises two outer legs 22 and a plurality of outer cross beams 24 connecting the two outer legs 22. Two outer legs 22 are disposed at the outer side of the two inner legs 12. Each inner leg 12 is slidably connected to an outer leg 22. The inner cross beams 14 of the inner ladder rack and the outer legs 22 of the outer ladder rack extend in a line. That is to say, the inner cross beams of the inner ladder rack are disposed between the two outer legs of the outer ladder rack and the inner cross beams are aligned with the outer legs. The cross sections of the inner leg 12 and the outer leg 22 both have a closed hollow tube shape. The front end face of the inner legs 12 is aligned with the front end face of the outer leg 22 and the rear end face of the inner leg 12 is aligned with the rear end face of the outer leg 22.

Figure 2:
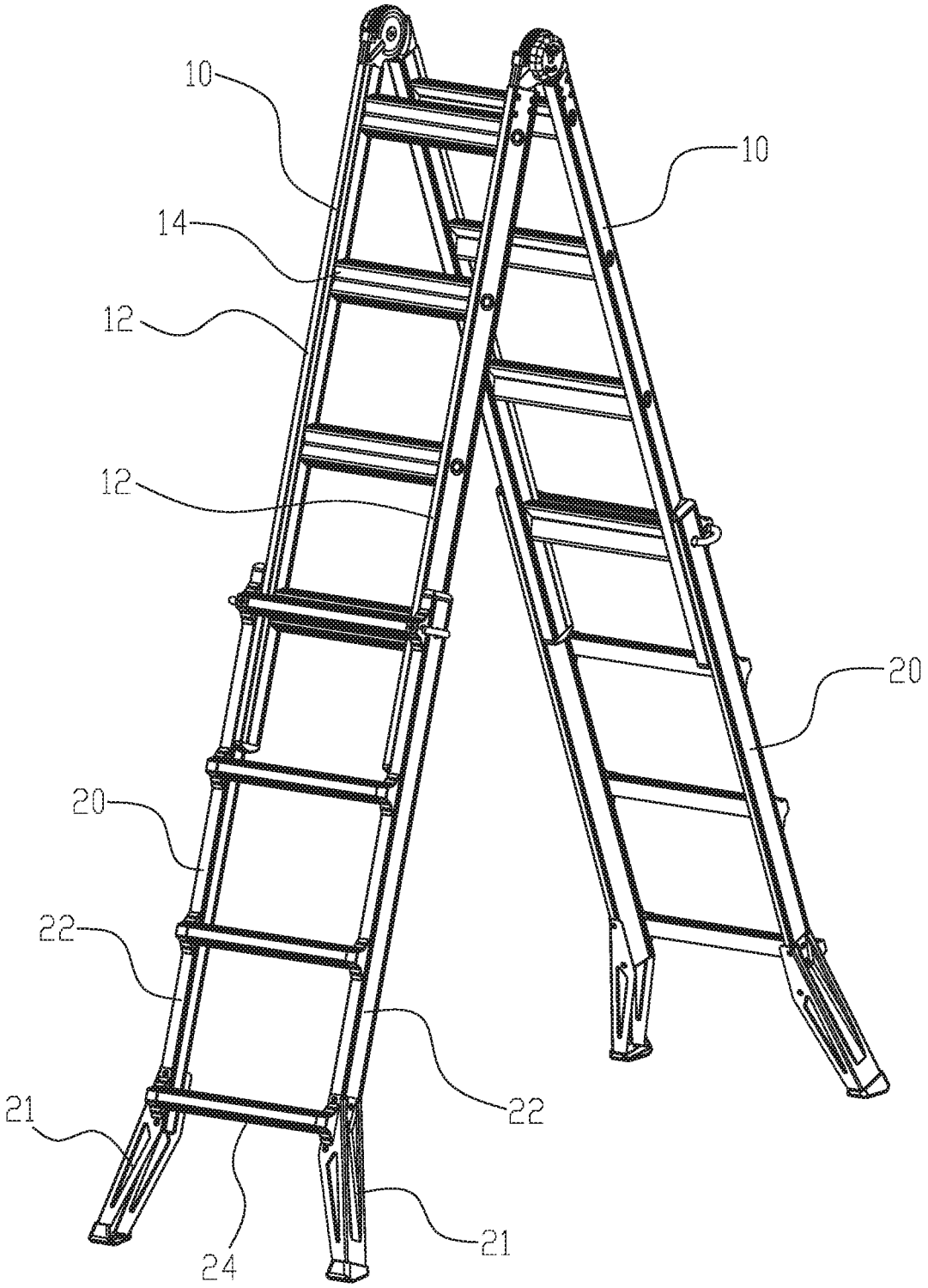
FIG. 2 illustrates a schematic diagram of the ladder of FIG. 1 in telescoping mode.
Figure 3:
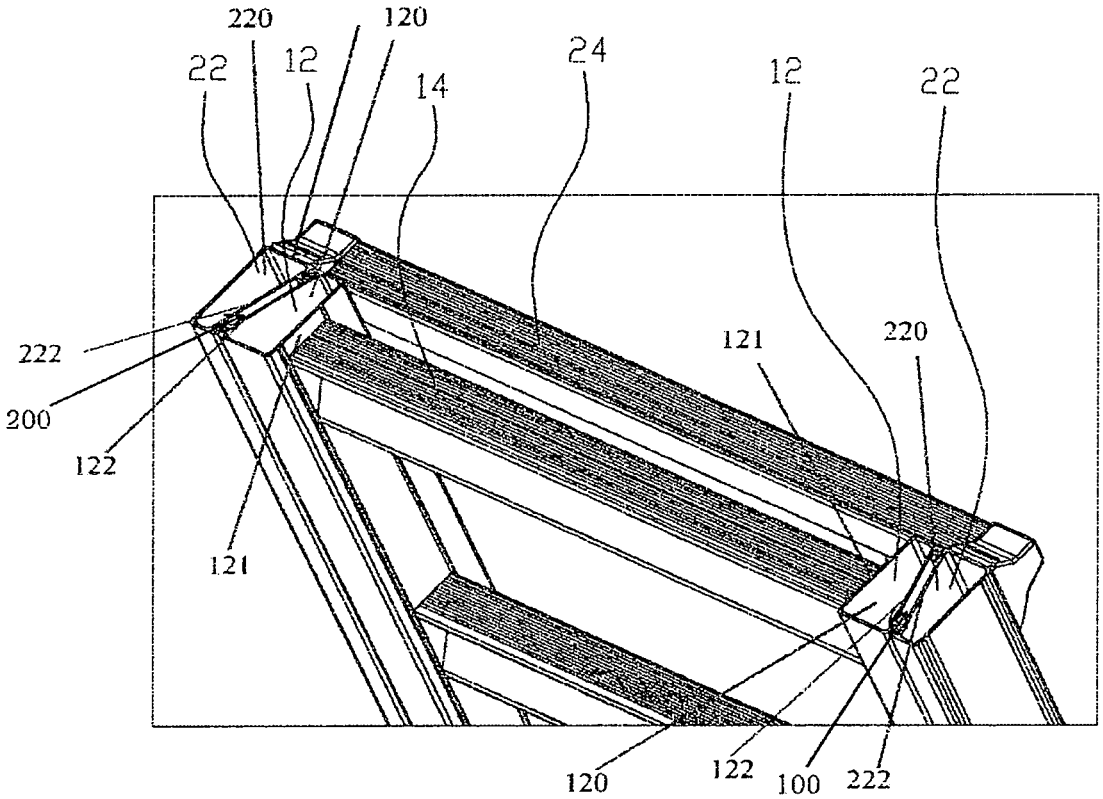
FIG. 3 illustrates a sectional diagram of a telescoping ladder rack of the ladder of FIG. 1.
Figure 3A:
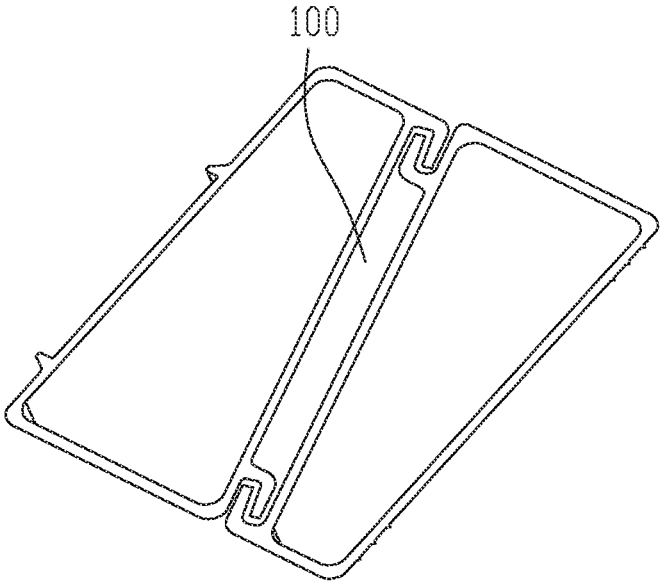
FIG. 3*a* illustrates a schematic diagram of a first sliding assembly of FIG. 3.
Figure 3B:
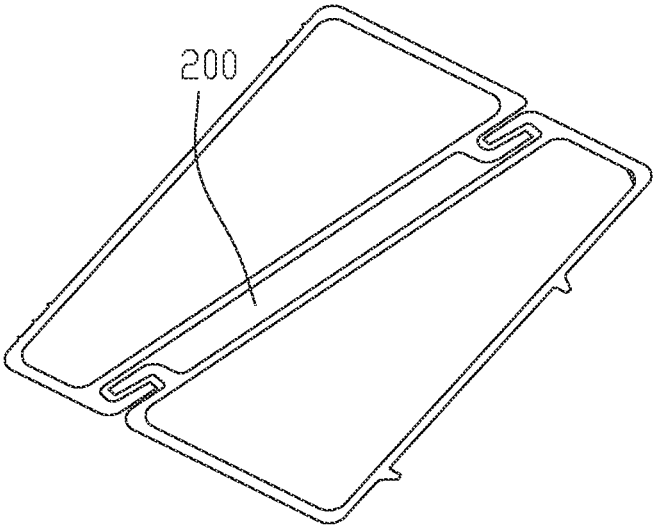
FIG. 3*b* illustrates a schematic diagram of a second sliding assembly of FIG. 3.

Referring to FIG. 2 and FIG. 3, the inner cross beams 14 are connected to the inner side of the inner leg 12 and the outer cross beams 24 are connected to the front end face of the outer leg faced to the user. The inner ladder rack 10 is embedded within the outer ladder rack. The inner legs 12 and the outer legs 22 are straight long tubes and are closed hollow tubes. The outer side of the inner leg 12 and the inner side of the outer leg 22 form sliding surfaces faced to each other.

Figure 4A:
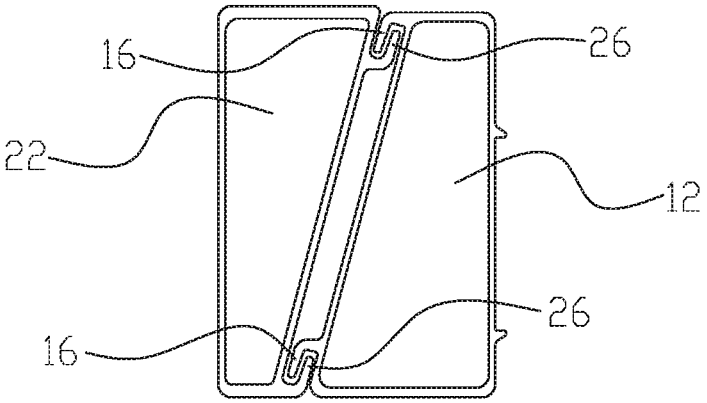
FIG. 4*a* illustrates a schematic diagram of the inner leg and an outer leg of the telescoping ladder rack in a first connecting way.
Figure 4B:
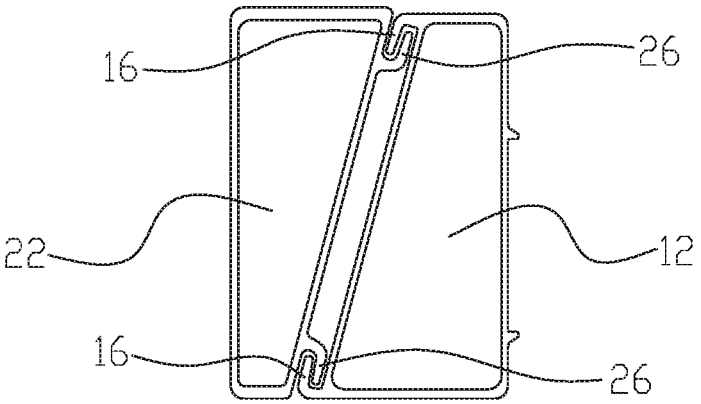
FIG. 4*b* illustrates a schematic diagram of the inner leg and an outer leg of the telescoping ladder rack in a second connecting way.
Figure 4C:
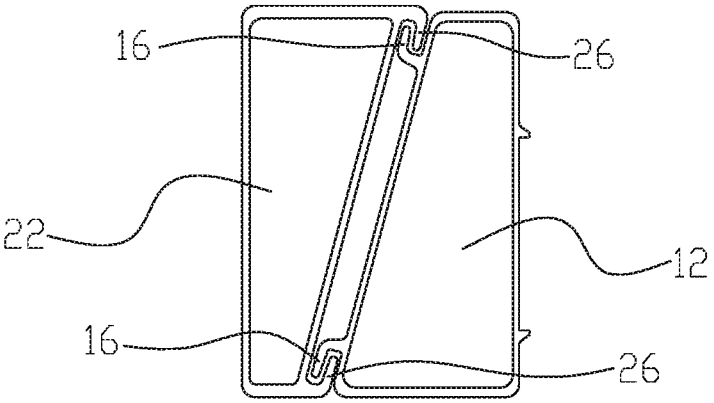
FIG. 4*c* illustrates a schematic diagram of the inner leg and a outer leg of the telescoping ladder rack in a third connecting way.
Figure 5A:
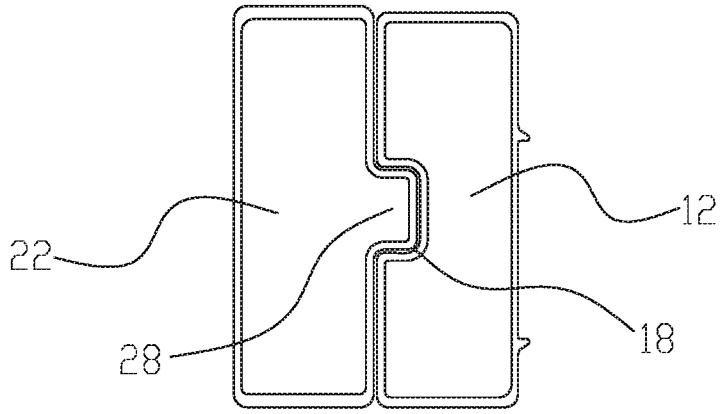
FIG. 5*a* illustrates a schematic diagram of the inner leg and an outer leg of the telescoping ladder rack in a fourth connecting way.
Figure 5B:
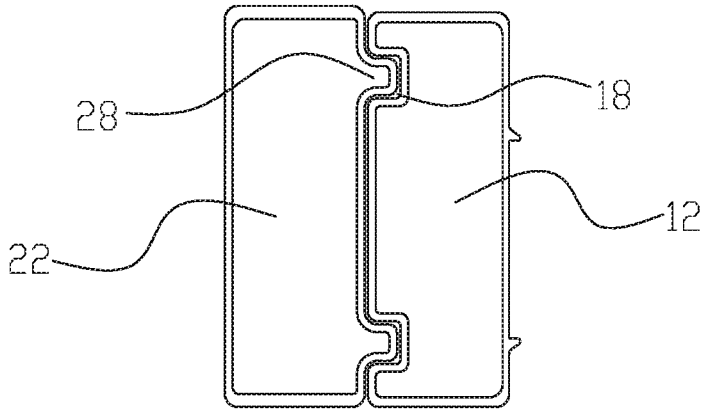
FIG. 5*b* illustrates a schematic diagram of the inner leg and a outer leg of the telescoping ladder rack in a fifth connecting way.
Figure 5C:
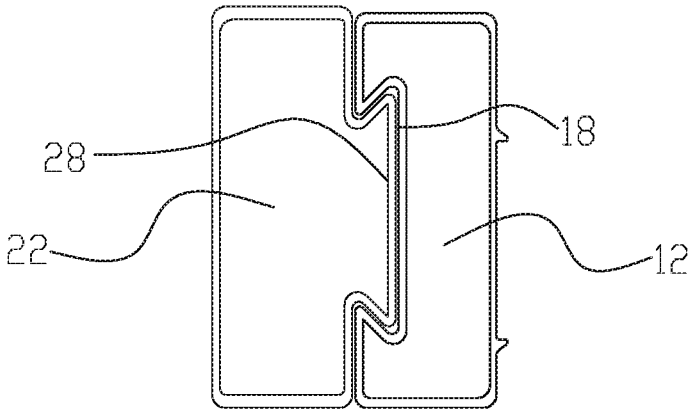
FIG. 5*c* illustrates a schematic diagram of the inner leg and an outer leg of the telescoping ladder rack in a sixth connecting way.
Figure 6A:
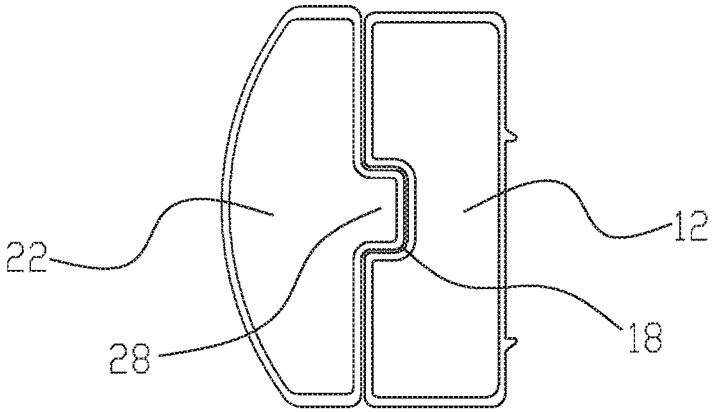
FIG. 6*a* illustrates a schematic diagram of the inner leg and an outer leg of the telescoping ladder rack in a seventh connecting way.
Figure 6B:
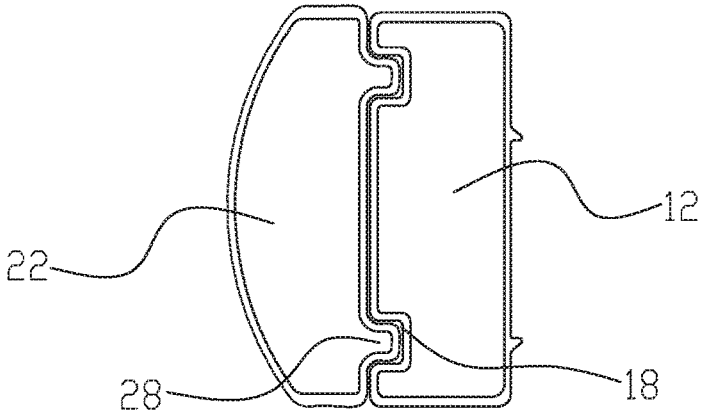
FIG. 6*b* illustrates a schematic diagram of the inner leg and an outer leg of the telescoping ladder rack in a eighth connecting way.
Figure 6C:
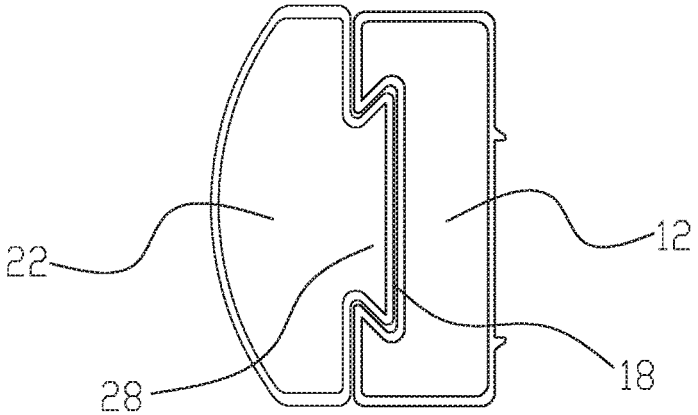
FIG. 6*c* illustrates a schematic diagram of the inner leg and an outer leg of the telescoping ladder rack in a ninth connecting way.

Referring to FIGS. 4*a*-4*c*, the sliding surface of the inner leg 12 is disposed with a hook lug 16 and the sliding surface of the outer leg 22 is disposed with a hook lug 26. The hook lug 16 of the sliding surface of the inner leg is locked to the hook lug 26 of the sliding surface of the outer leg. The number and structure of the hook lug 16 and the hook lug 26 are not limited provided that the sliding surfaces can be locked.

Referring to FIGS. 5*a*-6*c*, the sliding surface of the inner leg 12 is disposed with a sliding groove 18 and the sliding surface of the outer leg 22 is disposed with a sliding rail 28. The sliding rail 28 is slidably inserted to the sliding groove 18, achieving the connecting of the inner leg 12 and outer leg 22 in a slidably stretching way. In another case, the sliding surface of the outer leg is disposed with a sliding groove and the sliding surface of the inner leg is disposed with a sliding rail. The sliding rail is slidably inserted to the sliding groove. The sliding groove 18 is preferably a dovetail groove.

Referring to FIGS. 4*a*-6*c*, the cross section of the inner leg 12 is a right trapezoid or square and the cross section of the outer leg 22 is a right trapezoid or square. Preferably, the outer side surface of the outer leg 22 is curved and protrudes outwardly.

Figure 7:
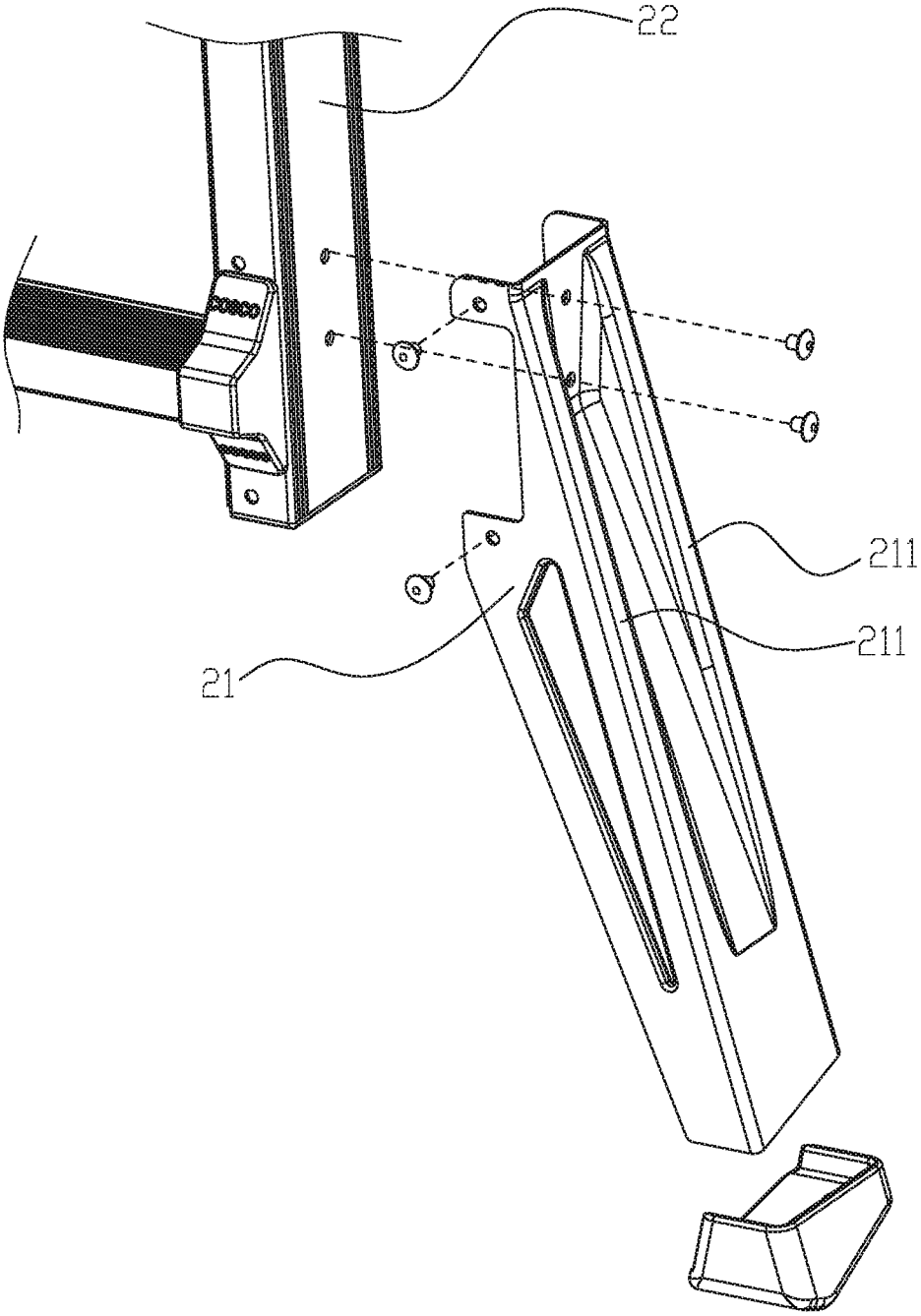
FIG. 7 illustrates a schematic diagram of the support element and the outer leg of the telescoping ladder rack of FIG. 1.

Referring to FIG. 2 and FIG. 7, the outer ladder rack 20 further comprises two support elements 21 respectively connected to the bottom portion of the two outer legs 22 at the outer sides of the outer legs 22. The two support elements 21 form a support structure when standing on the ground. The support elements 21 are iron elements, the outer legs 22 and the inner legs are aluminum elements. The support element 21 is a housing structure with an inner side opening. The support element 21 is locked to the outer leg 22 via the opening. The support element 21 is riveted to the outer leg 22 by rivets. Preferably, the outer side of the support element 21 has ribs 211 that protrude.

The two outer legs 22 comprise a first outer leg 22 (e.g., right instance of element 22 in FIG. 3) and a second outer leg 22 (e.g., left instance of element 22 in FIG. 3), and the two inner legs 12 comprise a first inner leg 12 (e.g., right instance of element 12 in FIG. 3) and a second inner leg 12 (e.g., left instance of element 12 in FIG. 3). In cross section, the first outer leg 22, the second outer leg 22, the first inner leg 12 and the second inner leg 12 respectively defines a closed hollow tube structure 220 or 120.

The inner cross beams 14 are positioned to connect a first surface 121 of the closed hollow tube structure 120 of the first inner leg 12 and a first surface 121 of the closed hollow tube structure 120 of the second inner leg 12 along inner sides thereof that face one another.

A first sliding assembly 100 is disposed between a first sliding surface 222 of the closed hollow tube structure 220 of the first outer leg 22 and a second sliding surface 122 of the closed hollow tube structure 120 of the first inner leg 12.

The first surface 121 of the closed hollow tube structure 120 of the first inner leg 12 is opposite to the second sliding surface 122.

A second sliding assembly 200 is disposed between a third sliding surface 222 of the closed hollow tube structure 220 of the second outer leg 22 and a fourth sliding surface 122 of the closed hollow tube structure 120 of the second inner leg 12.

The first surface 121 of the closed hollow tube structure 120 of the second inner leg 12 is opposite to the fourth sliding surface 122.

A center line of first outer leg 22 and the second outer leg 22 is on the inner cross beams 14.

The closed hollow tube structure 220 of the first outer leg 22 is defined in part by an inner side of the first outer leg 22 that faces the first inner leg 12, the first exterior surface of the first outer leg 22, and a second exterior surface of the first outer leg 22 diametrically opposite the inner side of the first outer leg 22.

The closed hollow tube structure 220 of the second outer leg 22 is defined in part by an inner side of the second outer leg 22 that faces the second inner leg 12, the first exterior surface of the second outer leg 22, and a second exterior surface of the second outer leg 22 diametrically opposite the inner side of the second outer leg 22.

Although the present invention has been described with reference to the preferred embodiments thereof for carrying out the invention, it will be apparent to those skilled in the art that a variety of modifications and changes may be made without departing from the scope of the invention which is intended to be defined by the appended claims.

The invention claimed is:

1. A telescoping ladder, comprising:

a first telescoping ladder rack having a top portion, and a second telescoping ladder rack that is a mirror image of the first telescoping ladder rack and having a top portion, wherein:

the top portion of the first telescoping ladder rack and the top portion of the second telescoping ladder rack are pivotally connected to form a structure that articulates to open and close the telescoping ladder, each of the first telescoping ladder rack and the second telescoping ladder rack comprises:

an outer ladder rack, and an inner ladder rack, the outer ladder rack comprises:

a first outer leg, a second outer leg, and an outer cross beam positioned to connect the first outer leg and the second outer leg along exterior surfaces thereof that face a user, the inner ladder rack comprises:

a first inner leg, and a second inner leg, in cross section, the first outer leg, the second outer leg, the first inner leg, and the second inner leg respectively defines a closed hollow tube structure, an inner cross beam is positioned to connect a first surface of the closed hollow tube structure of the first inner leg and a first surface of the closed hollow tube structure of the second inner leg along inner sides thereof that face one another, a first sliding assembly is disposed between a first sliding surface of the closed hollow tube structure of the first outer leg and a second sliding surface of the closed hollow tube structure of the first inner leg, the first surface of the closed hollow tube structure of the first inner leg is diametrically opposite to the second sliding surface, a second sliding assembly is disposed between a third sliding surface of the closed hollow tube structure of the second outer leg and a fourth sliding surface of the closed hollow tube structure of the second inner leg, the first surface of the closed hollow tube structure of the second inner leg is diametrically opposite to the fourth sliding surface, a center line of the first outer leg and the second outer leg is on the inner cross beam, the first sliding surface of the closed hollow tube structure of the first outer leg is inclined relative to the inner cross beam and is parallel to the second sliding surface of the closed hollow tube structure of the first inner leg, the third sliding surface of the closed hollow tube structure of the second outer leg is inclined relative to the inner cross beam and is parallel to the fourth sliding surface of the closed hollow tube structure of the second inner leg, the first surface of the closed hollow tube structure of the first inner leg is perpendicular to the inner cross beam, and the first surface of the closed hollow tube structure of the second inner leg is perpendicular to the inner cross beam.

2. The telescoping ladder according to claim 1, wherein:

the first sliding surface and the third sliding surface are respectively disposed with at least one inner hook lug extending therefrom, the second sliding surface and the fourth sliding surface are respectively disposed with at least one outer hook lug extending therefrom, each of the at least one inner hook lug engages and locks with a respective one of the at least one outer hook lug, the at least one inner hook lug of the first sliding surface and the at least one outer hook lug of the second sliding surface define the first sliding assembly, and the at least one inner hook lug of the third sliding surface and the at least one outer hook lug of the fourth sliding surface define the second sliding assembly.

3. The telescoping ladder according to claim 2, wherein:

the first outer leg and the second outer leg are respectively shaped as a right trapezoid or a square, and the first inner leg and the second inner leg are respectively shaped as a right trapezoid or a square.

4. The telescoping ladder according to claim 1, wherein:

the first sliding surface and the third sliding surface are respectively disposed with at least one inner hook lug extending therefrom, the second sliding surface and the fourth sliding surface are respectively disposed with at least one outer hook lug extending therefrom, the at least one inner hook lug of the first sliding surface and the at least one outer hook lug of the second sliding surface define the first sliding assembly, and the at least one inner hook lug of the third sliding surface and the at least one outer hook lug of the fourth sliding surface define the second sliding assembly.

5. The telescoping ladder according to claim 1, wherein:

the first sliding surface and the third sliding surface are respectively disposed with at least one outer hook lug extending therefrom, the second sliding surface and the fourth sliding surface are respectively disposed with at least one inner hook lug extending therefrom, the at least one outer hook lug of the first sliding surface and the at least one inner hook lug of the second sliding surface define the first sliding assembly, and the at least one outer hook lug of the third sliding surface and the at least one inner hook lug of the fourth sliding surface define the second sliding assembly.

6. The telescoping ladder according to claim 1, wherein:

the first outer leg and the second outer leg respectively has a bottom portion that is provided with a support leg connected thereto that extends laterally from the bottom portion, and each of the support legs has ribs that protrude to form a stabilizing support structure.

7. The telescoping ladder of claim 1, wherein:

the outer cross beam is directly connected to a first surface of the closed hollow tube structure of the first outer leg and a first surface of the closed hollow tube structure of the second outer leg along the exterior surfaces thereof that face the user, the first surface of the closed hollow tube structure of the first outer leg intersects the first sliding surface of the closed hollow tube structure of the first outer leg, and the first surface of the closed hollow tube structure of the second outer leg intersects the third sliding surface of the closed hollow tube structure of the second outer leg.

8. The telescoping ladder of claim 1, wherein:

the closed hollow tube structure of the first inner leg, the closed hollow tube structure of the second inner leg, the closed hollow tube structure of the first outer leg, and the closed hollow tube structure of the second outer leg have a rectangular cross section.

9. The telescoping ladder of claim 1, comprising:

a support leg having a u-shaped portion configured to surround a top surface, a side surface, and a bottom surface of the outer cross beam.

10. The telescoping ladder of claim 9, wherein:

the u-shaped portion defines a first opening configured for alignment with a first opening of the first outer leg and a second opening configured for alignment with a second opening of the first outer leg, and the second opening of the first outer leg is spaced apart from the first opening of the first outer leg by the outer cross beam.

11. A telescoping ladder, comprising:

a first telescoping ladder rack having a top portion, a second telescoping ladder rack that is a mirror image of the first telescoping ladder rack and having a top portion, and a support leg, wherein:

the top portion of the first telescoping ladder rack and the top portion of the second telescoping ladder rack are pivotally connected to form a structure that articulates to open and close the telescoping ladder, each of the first telescoping ladder rack and the second telescoping ladder rack comprises:

an outer ladder rack, and an inner ladder rack, the outer ladder rack comprises:

a first outer leg, a second outer leg, and an outer cross beam positioned to connect the first outer leg and the second outer leg along first exterior surfaces thereof that face a user, the inner ladder rack comprises:

a first inner leg, a second inner leg, and an inner cross beam positioned to connect the first inner leg and the second inner leg along inner sides thereof that face one another, in cross section, the first outer leg defines a closed hollow tube structure, the closed hollow tube structure of the first outer leg is defined in part by an inner side of the first outer leg that faces the first inner leg, the first exterior surface of the first outer leg, and a second exterior surface of the first outer leg diametrically opposite the inner side of the first outer leg, a first slider is disposed between the inner side of the first outer leg and an outer side of the first inner leg that faces the first outer leg, a center line of the first outer leg and the second outer leg is on the inner cross beam, the support leg has a u-shaped portion configured to surround a top surface, a side surface, and a bottom surface of the outer cross beam, the u-shaped portion defines a first opening configured for alignment with a first opening of the first outer leg and a second opening configured for alignment with a second opening of the first outer leg, and the second opening of the first outer leg is spaced apart from the first opening of the first outer leg by the outer cross beam.

12. The telescoping ladder according to claim 11, wherein:

the closed hollow tube structure of the first outer leg is further defined in part by a third exterior surface of the first outer leg that faces away from the user, the third exterior surface is diametrically opposite the first exterior surface of the first outer leg, and the third exterior surface is spaced apart from the first exterior surface.

13. The telescoping ladder of claim 11, wherein the support leg is configured to attach to the first exterior surface of the first outer leg and the second exterior surface of the first outer leg.

14. The telescoping ladder of claim 11, wherein:

the support leg has a planar portion extending in a direction substantially perpendicular from the u-shaped portion, and the planar portion defines a third opening configured for alignment with a third opening of the first outer leg.

15. The telescoping ladder of claim 14, wherein the third opening of the first outer leg is defined by the second exterior surface of the first outer leg.

16. A telescoping ladder, comprising:

a first telescoping ladder rack having a top portion, and a second telescoping ladder rack that is a mirror image of the first telescoping ladder rack and having a top portion, wherein:

the top portion of the first telescoping ladder rack and the top portion of the second telescoping ladder rack are pivotally connected to form a structure that articulates to open and close the telescoping ladder, each of the first telescoping ladder rack and the second telescoping ladder rack comprises:

an outer ladder rack, and an inner ladder rack, the outer ladder rack comprises:

a first outer leg, a second outer leg, and an outer cross beam positioned to connect the first outer leg and the second outer leg along exterior surfaces thereof that face a user, the inner ladder rack comprises:

a first inner leg, and a second inner leg, in cross section, the first outer leg, the second outer leg, the first inner leg, and the second inner leg respectively defines a closed hollow tube structure, an inner cross beam is positioned to connect a first surface of the closed hollow tube structure of the first inner leg and a first surface of the closed hollow tube structure of the second inner leg along inner sides thereof that face one another, a first sliding assembly is disposed between a first sliding surface of the closed hollow tube structure of the first outer leg and a second sliding surface of the closed hollow tube structure of the first inner leg, the first surface of the closed hollow tube structure of the first inner leg is diametrically opposite to the second sliding surface, a second sliding assembly is disposed between a third sliding surface of the closed hollow tube structure of the second outer leg and a fourth sliding surface of the closed hollow tube structure of the second inner leg, the first surface of the closed hollow tube structure of the second inner leg is diametrically opposite to the fourth sliding surface, a center line of the first outer leg and the second outer leg is on the inner cross beam, a support leg having a u-shaped portion is configured to surround a top surface, a side surface, and a bottom surface of the outer cross beam, the u-shaped portion defines a first opening configured for alignment with a first opening of the first outer leg and a second opening configured for alignment with a second opening of the first outer leg, and the second opening of the first outer leg is spaced apart from the first opening of the first outer leg by the outer cross beam.

* * * * *